US008601692B1

(12) United States Patent
Tatge et al.

(10) Patent No.: US 8,601,692 B1
(45) Date of Patent: Dec. 10, 2013

(54) METHOD OF ASSEMBLING A MARINE OUTBOARD ENGINE

(75) Inventors: Laverne Tatge, Kenosha, WI (US); Jean Daunais, Granby (CA)

(73) Assignee: BRP US Inc., Sturtevant, WI (US)

( * ) Notice: Subject to any disclaimer, the term of this patent is extended or adjusted under 35 U.S.C. 154(b) by 0 days.

(21) Appl. No.: 13/604,209

(22) Filed: Sep. 5, 2012

Related U.S. Application Data

(62) Division of application No. 11/963,080, filed on Dec. 21, 2007, now Pat. No. 8,276,274.

(51) Int. Cl.
*B21K 1/30* (2006.01)
*B63H 20/14* (2006.01)

(52) U.S. Cl.
USPC ..... 29/893.1; 29/893.2; 29/889.6; 440/75

(58) Field of Classification Search
USPC ..... 29/893.1, 893.2, 889.6; 440/75, 83
See application file for complete search history.

(56) References Cited

U.S. PATENT DOCUMENTS 1,903,350 A 4/1933 Landrum
3,148,557 A 9/1964 Shimanckas
3,368,420 A 2/1968 Alexander, Jr.
3,487,803 A 1/1970 Alexander, Jr.
4,270,408 A 6/1981 Wagner
5,009,621 A * 4/1991 Bankstahl et al. ..... 440/75
5,112,259 A 5/1992 McElroy et al.
6,361,387 B1 3/2002 Clarkson
7,530,869 B2 5/2009 Ide et al.
7,625,255 B2 12/2009 Ide et al.
7,827,687 B2 11/2010 Mansfield et al.

* cited by examiner

*Primary Examiner* — Sarang Afzali
(74) *Attorney, Agent, or Firm* — BCF LLP

(57) ABSTRACT

A method of assembling an outboard engine is disclosed. The outboard engine has first and second driveshafts, each having a helical gear on a first end and a driving gear on a second end. A driven shaft has a driven gear. The method comprises: rotating the driven shaft; measuring an axial displacement of one of the first and second helical gears with respect to the engine casing; selecting a shim based at least in part on the measurement of the relative axial displacement; and placing the shim on the one of the first and second driveshafts at a position axially below the helical gear. A method of assembling a marine outboard engine comprising moving a height adjustment member from a first position to a second position based on the relative axial displacement is also disclosed. An outboard engine with first and second helical gears at different heights is also disclosed.

5 Claims, 7 Drawing Sheets

METHOD OF ASSEMBLING A MARINE OUTBOARD ENGINE

CROSS-REFERENCE

The present application is a divisional of U.S. patent application Ser. No. 11/963,080, filed Dec. 21, 2007 now U.S. Pat. No. 8,276,274, the entirety of which is incorporated herein by reference.

FIELD OF THE INVENTION

The present invention relates to a method of assembling a marine outboard engine.

BACKGROUND OF THE INVENTION

Many boats and other watercraft are driven by one or more outboard engines. Marine outboard engines have an engine, such as an internal combustion engine, that drives a vertically oriented driveshaft. The driveshaft is coupled to a driving gear that drives a driven gear mounted on a horizontally oriented propeller shaft that, in turn, drives a propeller to propel the boat forward.

In some applications, such as boat racing, it is desired to use a high-powered engine to provide a large amount of horsepower and torque for driving the propeller. In high-powered applications, all of the intermediate components between the engine and the propeller, such as the driveshaft, propeller shaft and the driving and driven gears therebetween, must be made correspondingly larger to reliably transmit the power, resulting in increased size and weight. In particular, the greater power requires a larger driven gear on the propeller shaft, which in turn may require a larger gear case housing. A larger gear case housing creates additional drag when the gear case housing is submerged in the body of water while the engine is being used, with an attendant decrease in performance and efficiency. In addition, because higher-powered engines require larger gear case housings than lower-powered engines, an increased number of parts must be designed, manufactured and kept in inventory and an attendant increase in manufacturing cost.

One alternative method of delivering a large amount of power to the propeller shaft is to provide two smaller driveshafts driving a single driven gear on the propeller shaft. In this arrangement, each driveshaft theoretically delivers half of the power output from the engine, and as a result each driveshaft can be smaller in size, and the driving and driven gears can be made correspondingly smaller, resulting in a lighter and more compact arrangement.

However, the arrangement having two driveshafts has drawbacks. The gears on the driveshafts and the propeller shaft generally do not mesh perfectly, due to manufacturing tolerances in the machining of the gears and difficulties in obtaining proper timing between the driving and driven gears during assembly of the engine. As a result, the power from the engine is unevenly distributed between the two driveshafts, resulting in increased and uneven wearing of the gears and the risk of applying more power to one of the driveshafts and its corresponding driving gear than they are designed to support.

One way of remedying these drawbacks is to manually attempt to mesh the teeth of the gears in numerous different arrangements, until one arrangement is found that satisfactorily balances the load between the two driveshafts. This procedure is time-consuming, resulting in increased manufacturing cost, and does not necessarily result in a complete balancing of the load.

Therefore, there is a need for a method of assembling a marine outboard engine to provide improved load balancing between the two driveshafts.

There is also a need for a marine outboard engine having improved load balancing between the two driveshafts.

SUMMARY OF THE INVENTION

It is an object of the present invention to ameliorate at least some of the inconveniences present in the prior art.

It is a further object of the present invention to provide a method of assembling a marine outboard engine to provide improved load balancing between the two driveshafts.

It is a further object of the present invention to provide a marine outboard engine having improved load balancing between the two driveshafts.

In one aspect, the invention provides a method of assembling a marine outboard engine having an engine casing. A first driveshaft has a first end and a second end. The first end has a first helical gear disposed thereon. The second end has a first driving gear disposed thereon. A second driveshaft has a first end and a second end. The first end has a second helical gear disposed thereon. The second end has a second driving gear disposed thereon. A driven shaft has at least one driven gear disposed thereon. The method comprises: placing the first driveshaft in the engine casing such that the first helical gear is free to move in an axial direction relative to the engine casing; placing the driven shaft in the engine casing such that one of the at least one driven gear meshes with the first driving gear; placing the second driveshaft in the engine casing such that: the second driving gear meshes with one of the at least one driven gear, the first helical gear meshes with the second helical gear, and the second helical gear is free to move in an axial direction relative to the engine casing; rotating the driven shaft; measuring an axial displacement of one of the first and second helical gears with respect to the engine casing as a result of the rotation of the driven shaft; selecting a shim based at least in part on the measurement of the relative axial displacement; and placing the shim on the one of the first and second driveshafts at a position axially below the helical gear disposed on the one of the first and second driveshafts.

In a further aspect, the method comprises measuring the relative axial displacement includes placing a position indicator on at least one of the first and second helical gears.

In a further aspect, the method comprises fixing the first and second helical gears in position after placing the shim, such that axial movement of the first and second helical gears in an axial direction is substantially prevented after placing the shim.

In a further aspect, the at least one driven gear is a single driven gear. Placing the driven shaft in the engine casing such that one of the at least one driven gear meshes with the first driving gear comprises placing the driven shaft in the engine casing such that the driven gear meshes with the first driving gear. Placing the second driveshaft in the engine casing such that the second driving gear meshes with one of the at least one driven gear comprises placing the second driveshaft in the engine casing such that the second driving gear meshes with the driven gear.

In a further aspect, the at least one driven gear comprises first and second driven gears. Placing the driven shaft in the engine casing such that one of the at least one driven gear meshes with the first driving gear comprises placing the driven shaft in the engine casing such that the first driven gear meshes with the first driving gear. Placing the second driveshaft in the engine casing such that the second driving gear meshes with one of the at least one driven gear comprises placing the second driveshaft in the engine casing such that the second driving gear meshes with the second driven gear.

In an additional aspect, a marine outboard engine comprises an engine casing. A generally vertically oriented first driveshaft has a first end and a second end. The first end has a first helical gear disposed thereon. The second end has a first driving gear disposed thereon. A generally vertically oriented second driveshaft has a first end and a second end. The first end has a second helical gear disposed thereon. The second end has a second driving gear disposed thereon. A driven shaft has at least one driven gear disposed thereon. The at least one driven gear engages at least one of the first and second driving gears. At least one height adjustment member is disposed on at least one of the first driveshaft and the second driveshaft such that the first helical gear and the second helical gear are at different heights.

In a further aspect, the driven shaft is a propeller shaft having a propeller mounted thereon.

In a further aspect, the first and second driving gears are first and second pinion gears, and the at least one driven gear is at least one bull gear.

In a further aspect, the at least one height adjustment member is a shim placed on only one of the first driveshaft and the second driveshaft.

In a further aspect, the at least one height adjustment member is at least one threaded height adjustment member disposed below at least one of the first and second helical gears.

In a further aspect, the at least one driven gear is a single driven gear. The driven gear engages the first and second driving gears.

In a further aspect, the at least one driven gear comprises first and second driven gears. The first driven gear engages the first driving gear. The second driven gear engages the second driving gear.

In an additional aspect, the invention provides a method of assembling a marine outboard engine having an engine casing. A first driveshaft has a first end and a second end. The first end has a first helical gear disposed thereon. The second end has a first driving gear disposed thereon. A second driveshaft has a first end and a second end. The first end has a second helical gear disposed thereon. The second end has a second driving gear disposed thereon. At least one height adjustment member is associated with at least one of the first and second helical gears. The at least one height adjustment member is movable between a first position and a second position vertically higher than the first position. A driven shaft has at least one driven gear disposed thereon. The method comprises: placing the first driveshaft in the engine casing such that the first helical gear is free to move in an axial direction relative to the engine casing; placing the driven shaft in the engine casing such that one of the at least one driven gear meshes with the first driving gear; placing the second driveshaft in the engine casing such that: the second driving gear meshes with one of the at least one driven gear, the first helical gear meshes with the second helical gear, and the second helical gear is free to move in an axial direction relative to the engine casing; rotating the driven shaft to cause an axial displacement of one of the first and second helical gears with respect to the engine casing as a result of the rotation of the driven shaft; and moving the at least one height adjustment member from the first position to the second position, the height of the second position being determined based at least in part on the magnitude of the relative axial displacement.

In a further aspect, the method further comprises fixing the first and second helical gears in position after moving the at least one height adjustment member, such that axial movement of the first and second helical gears in an axial direction is substantially prevented.

In a further aspect, the at least one height adjustment member is at least one threaded height adjustment member. Moving the at least one height adjustment member comprises rotating the at least one height adjustment member.

In a further aspect, the at least one driven gear is a single driven gear. Placing the driven shaft in the engine casing such that one of the at least one driven gear meshes with the first driving gear comprises placing the driven shaft in the engine casing such that the driven gear meshes with the first driving gear. Placing the second driveshaft in the engine casing such that the second driving gear meshes with one of the at least one driven gear comprises placing the second driveshaft in the engine casing such that the second driving gear meshes with the driven gear.

In a further aspect, the at least one driven gear comprises first and second driven gears. Placing the driven shaft in the engine casing such that one of the at least one driven gear meshes with the first driving gear comprises placing the driven shaft in the engine casing such that the first driven gear meshes with the first driving gear. Placing the second driveshaft in the engine casing such that the second driving gear meshes with one of the at least one driven gear comprises placing the second driveshaft in the engine casing such that the second driving gear meshes with the second driven gear.

In the present application, terms related to spatial orientation such as forwardly, rearwardly, left, and right, should be interpreted are as they would normally be understood by a driver of a watercraft sitting thereon in a normal driving position, when the engine is mounted on the watercraft. In addition, the term "axial direction", when used in reference to a particular shaft, refers to a direction along the longitudinal axis of that shaft.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

Figure 1:
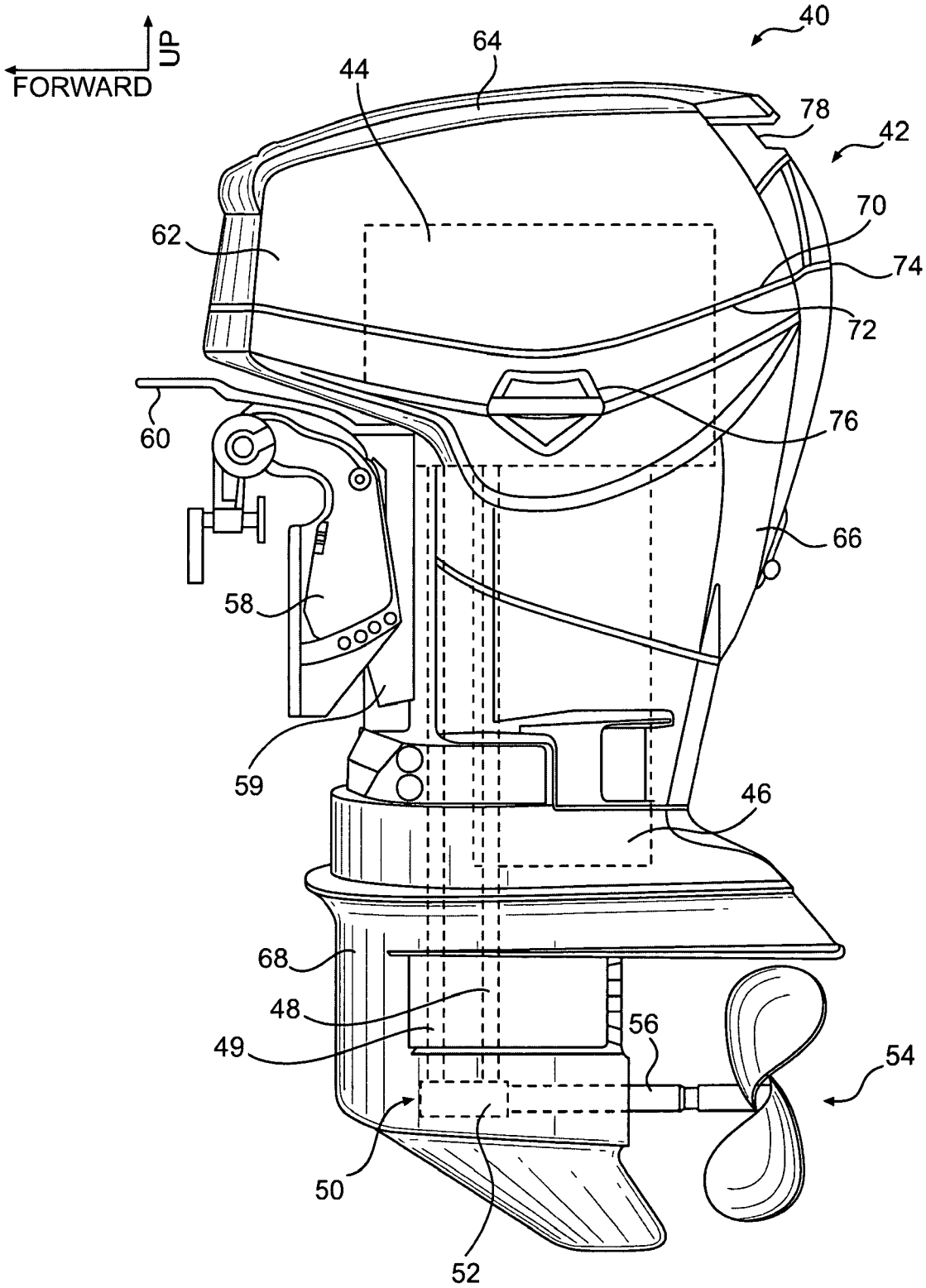
FIG. 1 is a side elevation view of a marine outboard engine to which the present invention can be applied.

Referring to FIG. 1, a marine outboard engine 40 will be described according to a first embodiment. It should be understood that the present invention is applicable to other marine applications involving propellers, such as inboard engines and stern drives.

FIG. 1 is a side view of a marine outboard engine 40 having a cowling 42. The cowling 42 surrounds and protects an engine 44, shown schematically. The engine 44 may be any suitable engine known in the art, such as an internal combustion engine. An exhaust system 46, shown schematically, is connected to the engine 44 and is also surrounded by the cowling 42.

The engine 44 is coupled to two vertically oriented driveshafts 48 and 49. The driveshafts 48, 49 are coupled to a drive mechanism 50, which includes a transmission 52 and a bladed rotor, such as a propeller 54 mounted on a propeller shaft 56. The driveshafts 48, 49 and the transmission 52 will be described below in greater detail. The propeller shaft 56 is generally perpendicular to the driveshafts 48, 49. The drive mechanism 50 could also include a jet propulsion device, turbine or other known propelling device. Other known components of an engine assembly are included within the cowling 42, such as a starter motor and an alternator. As it is believed that these components would be readily recognized by one of ordinary skill in the art, further explanation and description of these components will not be provided herein.

A stern bracket 58 is connected to the cowling 42 via the swivel bracket 59 for mounting the outboard engine 40 to a watercraft. The stern bracket 58 can take various forms, the details of which are conventionally known.

A linkage 60 is operatively connected to the cowling 42, to allow steering of the outboard engine 40 when coupled to a steering mechanism of a watercraft, such as a steering wheel.

The cowling 42 includes several primary components, including an upper motor cover 62 with a top cap 64, and a lower motor cover 66. A lowermost portion, commonly called the gear case 68, is attached to the exhaust system 46. The upper motor cover 62 preferably encloses the top portion of the engine 44. The lower motor cover 66 surrounds the remainder of the engine 44 and the exhaust system 46. The gear case 68 encloses the transmission 52 and supports the drive mechanism 50, in a known manner. The propeller shaft 56 extends from the gear case 68 and supports the propeller 54.

The upper motor cover 62 and the lower motor cover 66 are made of sheet material, preferably plastic, but could also be metal, composite or the like. The lower motor cover 66 and/or other components of the cowling 42 can be formed as a single piece or as several pieces. For example, the lower motor cover 66 can be formed as two lateral pieces that mate along a vertical joint. The lower motor cover 66, which is also made of sheet material, is preferably made of composite, but could also be plastic or metal. One suitable composite is fiberglass.

A lower edge 70 of the upper motor cover 62 mates in a sealing relationship with an upper edge 72 of the lower motor cover 66. A seal 74 is disposed between the lower edge 70 of the upper motor cover 62 and the upper edge 72 of the lower motor cover 66 to form a watertight connection.

A locking mechanism 76 is provided on at least one of the sides of the cowling 42. Preferably, locking mechanisms 76 are provided on each side of the cowling 42.

The upper motor cover 62 is formed with two parts, but could also be a single cover. As seen in FIG. 1, the upper motor cover 62 includes an air intake portion 78 formed as a recessed portion on the rear of the cowling 42. The air intake portion 78 is configured to prevent water from entering the interior of the cowling 42 and reaching the engine 44. Such a configuration can include a tortuous path. The top cap 64 fits over the upper motor cover 62 in a sealing relationship and preferably defines a portion of the air intake portion 78. Alternatively, the air intake portion 78 can be wholly formed in the upper motor cover 62 or even the lower motor cover 66.

Figure 2:
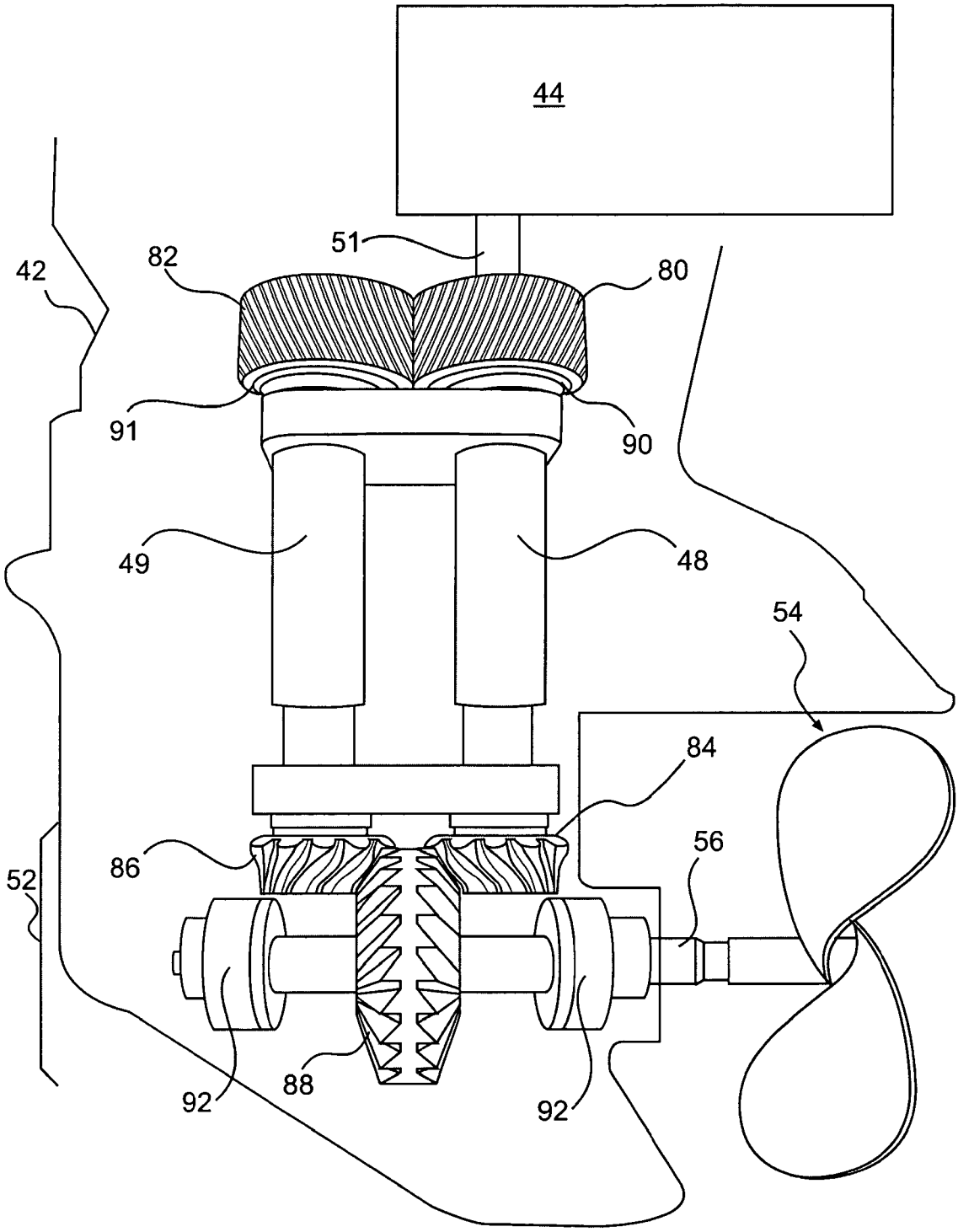
FIG. 2 is a partial cross-sectional view of an outboard engine to which the present invention can be applied.

Referring to FIG. 2, the mechanism by which the engine 44 drives the propeller 54 will now be described in more detail.

The output shaft 51 of the engine 44 is coupled to the driveshaft 48. It is contemplated that the output shaft 51 of the engine 44 may be coupled to the driveshaft 48 via a gear arrangement or any other suitable connection. It is further contemplated that the output shaft 51 may instead be coupled to the driveshaft 49. A helical gear 80 is mounted on the driveshaft 48 via a spline connection or any other suitable connection. The gear 80 meshes with a second helical gear 82 that is splined or otherwise suitably mounted on the driveshaft 49, such that the engine 44 drives both driveshafts 48, 49 simultaneously to rotate in opposite directions at the same rotational speed. The helical gears 80, 82 arc preferably slidably mounted to the respective driveshafts 48, 49 via the spline connections and free to move with respect thereto along an axial direction of the driveshafts 48, 49.

A first pinion gear 84 is mounted to the bottom of the driveshaft 48, and a second pinion gear 86 is mounted to the bottom of the driveshaft 49. The propeller shaft 56 is supported below the driveshafts 48, 49 by bearings 92 that are preferably tapered roller bearings capable of partially absorbing the forces exerted on the propeller shaft 56 by the propeller 54 while the engine 40 is in use. The tapered roller bearings 92 are preferably pre-loaded to better absorb the forces on the propeller shaft 56. A bull gear 88 is splined on the propeller shaft 56 such that the bull gear 88 is free to move axially along the propeller shaft 56 in response to loads exerted thereon. The bull gear 88 is disposed between the two pinion gears 84, 86, and is suitably shaped so that each of the pinion gears 84, 86 meshes with the teeth on one side of the bull gear 88. The pinion gears 84, 86 rotate in opposite directions, and as a result the portions of the pinion gears 84, 86 that are in contact with the bull gear 88 drive the bull gear 88 in the same direction, thereby rotating the propeller shaft 56 to drive the propeller 54.

Figure 3:
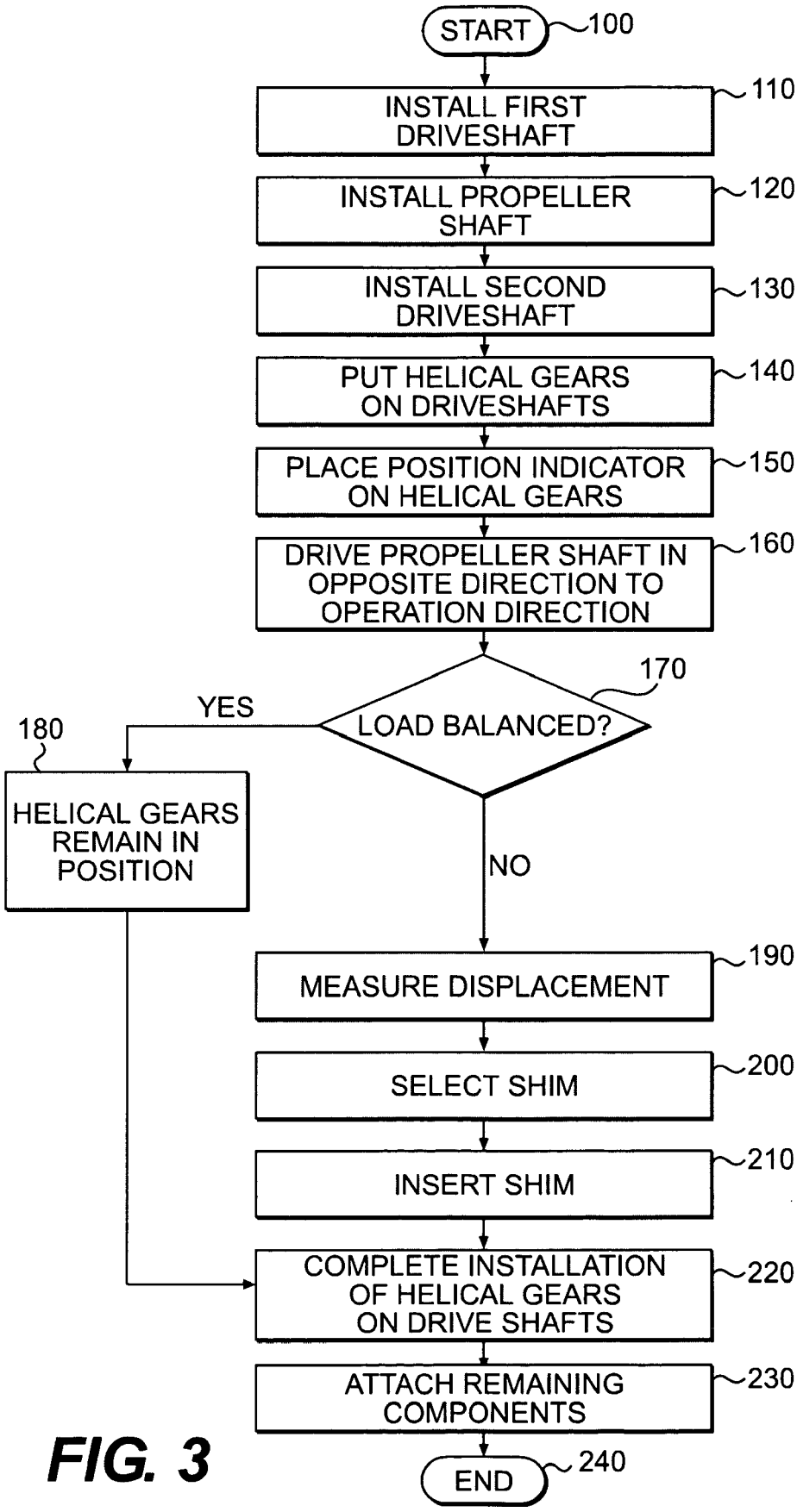
FIG. 3 is a logic diagram of a method of assembling an outboard engine according to the present invention.

Referring to FIG. 3, a method of assembling the outboard engine 40 will now be described according to an embodiment of the invention, starting at step 100.

At step 110, the driveshaft 49 is installed in the outboard engine 40 such that the gear 86 is disposed within the gear case 68. A shoulder 91 (shown in FIG. 2) extends radially outward from the helical gear 82 and is supported on a part of the engine 40 such that the helical gear 82 is free to move upward in an axial direction.

At step 120, the propeller shaft 56 and bull gear 88 are installed in the gear case 68, such that the bull gear 88 meshes with the gear 86.

At step 130, the driveshaft 48 is installed in the outboard engine 40 parallel to the driveshaft 49, such that the gear 84 is disposed within the gear case 68 and meshes with the bull gear 88. A shoulder 90 (shown in FIG. 2) extends radially outward from the helical gear 80 and is supported on a part of the engine 40 such that the helical gear 80 is free to move upward in an axial direction.

At step 140, the helical gears 80 and 82 are disposed on the driveshafts 48 and 49, respectively, such that the gears 80 and 82 mesh with each other.

At step 150, two position indicators (not shown) are placed on the top of the respective gears 80, 82 so that their vertical position can be measured relative to a reference position. It is contemplated that the position indicators may be any suitable indicators known in the art that allow a determination of how far either of the helical gears 80, 82 has moved relative to the reference position. The reference position may be the initial position of either helical gear 80, 82 or the position of any reference object such as a part of the outboard engine 40 with respect to which either helical gear 80, 82 may move. It is contemplated that only a single position indicator may be used, by placing the position indicator on one or the other of the respective gears 80, 82. If only a single position indicator is used, and the gear 80, 82 that moves vertically is not the one on which the position indicator was placed, it may be necessary to repeat steps 150-190 with the position indicator placed on the other one of the gears 80, 82.

At step 160, the propeller shaft 56 is driven in either the clockwise or the counter-clockwise direction by an external force. The direction in which the propeller shaft 56 is driven is the direction opposite the normal forward direction of rotation of the propeller shaft 56 when the outboard engine 40 is in operation. The external force may be applied by a machine that exerts a torque on the propeller shaft 56, or by a person manually turning the propeller shaft 56. The rotation of the propeller shaft 56 drives the bull gear 88, which in turn drives the gears 84 and 86.

At step 170, the load exerted by the bull gear 88 is either balanced between the gears 84 and 86, or unbalanced such that a higher load is exerted on one or the other of the gears 84 and 86.

At step 180, if the load from the bull gear 88 is evenly balanced between the gears 84 and 86, the helical gears 80, 82 will remain in position. The process continues at step 220.

Figure 4:
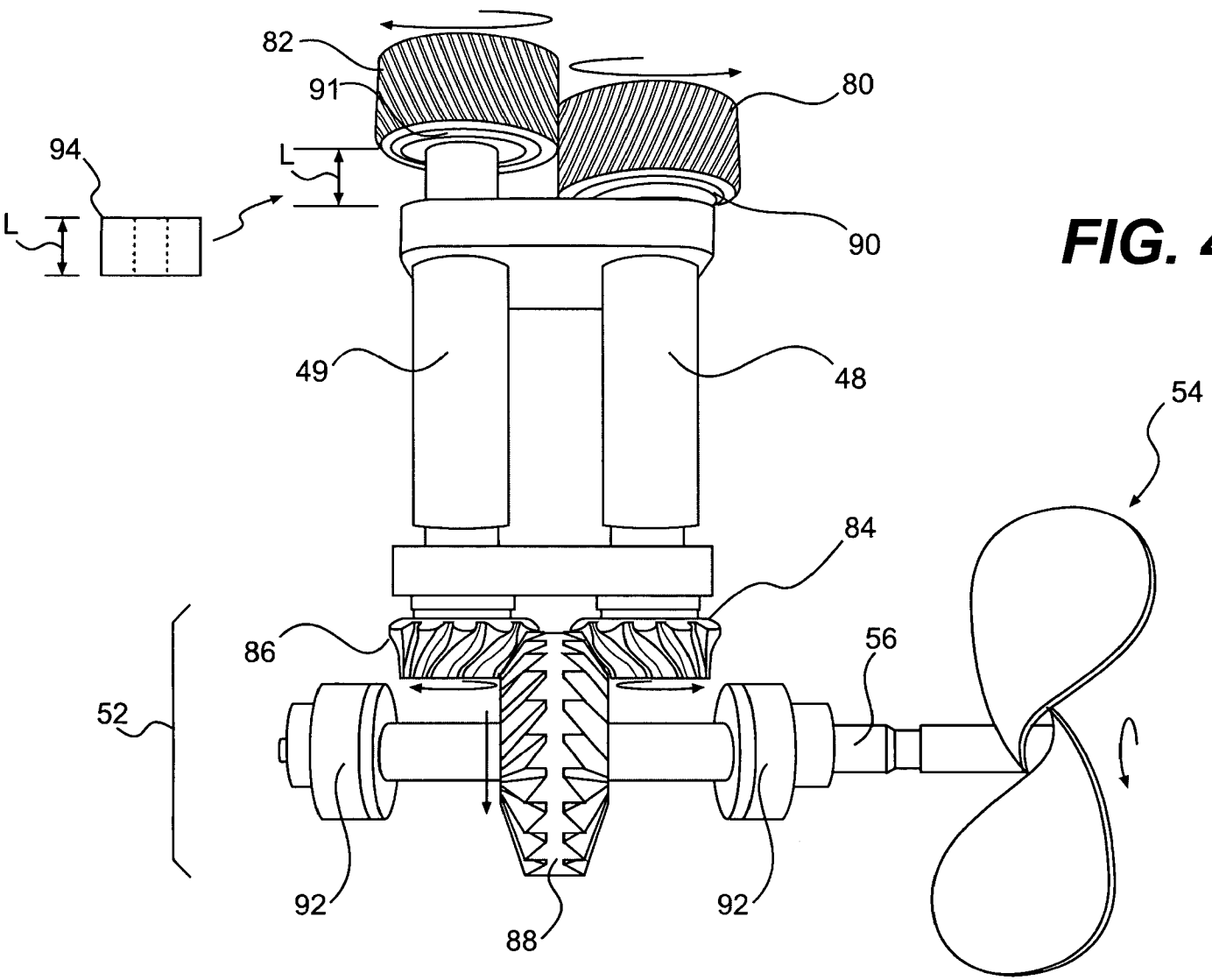
FIG. 4 is a partial cross-sectional view of an outboard engine assembled using the method of FIG. 3.

At step 190, if the load from the bull gear 88 is unbalanced between the gears 84 and 86, one of the driveshafts 48, 49 will be driven with a higher load than the other of the driveshafts 48, 49. As a result, the driveshaft 48, 49 with the higher load will attempt to rotate at a faster rate than the driveshaft 48, as long as the loads remain unbalanced. The faster rate of rotation of one of the driveshafts 48, 49, in combination with the angled threads of the helical gears 80, 82, causes one of the helical gears 80, 82 to move upwardly relative to the other helical gear 80, 82. Whether it is the helical gear 80 or the helical gear 82 that moves upwardly will depend on a combination of the direction of rotation of the driveshafts 48, 49, the handedness of the helical gears 80, 82 and which of the driveshafts 48, 49 experiences the higher load. FIG. 4 schematically illustrates the case in which the propeller shaft 56 is rotated counter-clockwise as seen from the rear of the outboard engine 40 (indicated by the arrow), the helical gear 80 is right-handed, the helical gear 82 is left-handed, and the driveshaft 49 is driven with a higher load than the driveshaft 48. In this case, the helical gear 82 will move upwardly as shown. The effects of other combinations of these parameters should be readily understood by persons skilled in the art, and will not be discussed herein in detail. Once the helical gears 80, 82 have reached a stable configuration in which the load from the bull gear 88 is evenly balanced between the gears 84 and 86, the helical gears 80, 82 no longer move vertically relative to each other. The helical gear 82 is raised with respect to the helical gear 80 by a distance L (shown in FIG. 4). The distance L is measured using the position indicator.

At step 200, a shim 94 (shown in FIG. 4) is selected having a thickness L.

At step 210, the shim 94 is inserted below the shoulder 91 of the raised helical gear 82 to maintain it in the raised position corresponding to a balanced load between the helical gears 80, 82. For example, if the distance L was measured to be 0.5 mm at step 190, a shim 94 having a thickness of 0.5 mm will be selected and inserted, as seen in FIG. 4.

At step 220, the installation of the helical gears 80, 82 in the outboard engine 40 is completed, such that the helical gears 80, 82 are fixed in position and are no longer free to move relative to each other in an axial direction. The helical gears 80, 82 may be fixed in position in any suitable way, such as by applying a threaded lock nut (not shown) to a threaded portion (not shown) on one end of each driveshaft 48, 49.

At step 230, the remaining components of the outboard engine 40 are attached.

The process ends at step 240.

It is contemplated that some of the above steps may be performed in a different order. For example, the helical gears 80, 82 may be placed on the respective driveshafts 48, 49 before the driveshafts 48, 49 are installed in the outboard engine 20. In addition, the driveshafts 48, 49 and the propeller shaft 56 may be installed in any convenient order.

Figure 5:
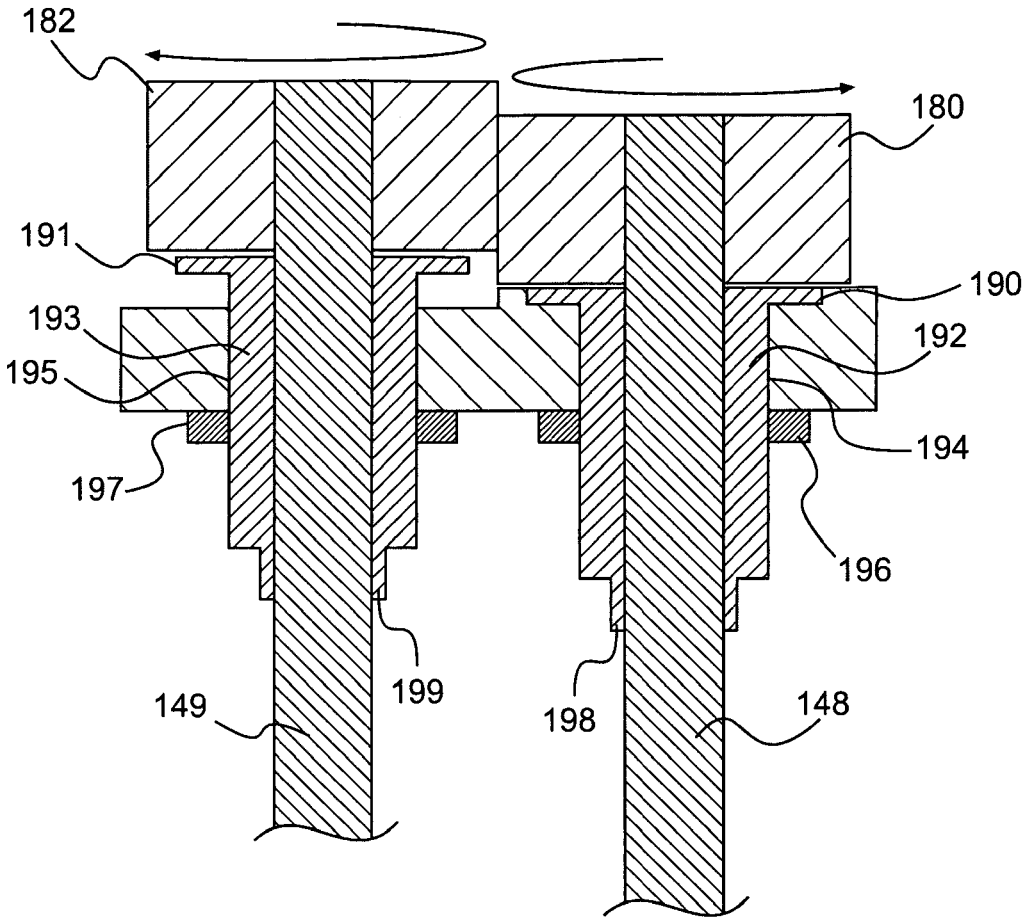
FIG. 5 is a partial cross-sectional view of an outboard engine according to a second embodiment.

Referring to FIG. 5, a portion of a marine outboard engine (not shown) will be described according to an alternative embodiment.

The helical gears 180, 182 are respectively mounted on the driveshafts 48, 49 in the same manner as the helical gears 80, 82 of FIGS. 2 and 4. The helical gears 180, 182 are supported respectively by shoulders 190 and 191 that form part of height adjusting members 192, 193 respectively. Each height adjustment member 192, 193 has a threaded exterior surface that engages a corresponding threaded opening 194, 195. Threaded lock nuts 196, 197 engage the threaded surfaces of the corresponding height adjustment members 192, 193 and can be adjusted to lock the height adjustment members 192, 193 and prevent them from moving in an axial direction of the shafts 148, 149. The remaining parts of the outboard engine of the present embodiment are similar in structure and function to the parts of the outboard engine 40, and will not be described in detail.

When the method of FIG. 3 is performed on the engine of FIG. 5, the measurement of the distance L in step 190, as well as steps 200 and 210, are replaced by a step in which the height of the height adjustment member 193 corresponding to the raised gear 182 is raised by the distance L, preferably by using a wrench or other suitable tool to grip a suitably-shaped extension 199 on the height adjustment member 193 and rotating the height adjustment member 193 until the desired height is reached. A similarly-shaped extension 198 is provided on the height adjustment member 192.

At step 220, the helical gears 180 and 182 are fixed in position by adjusting the lock nuts 196, 197.

The remaining steps are carried out as in the embodiment of FIG. 3, and will not be described again in detail.

Figure 6A:
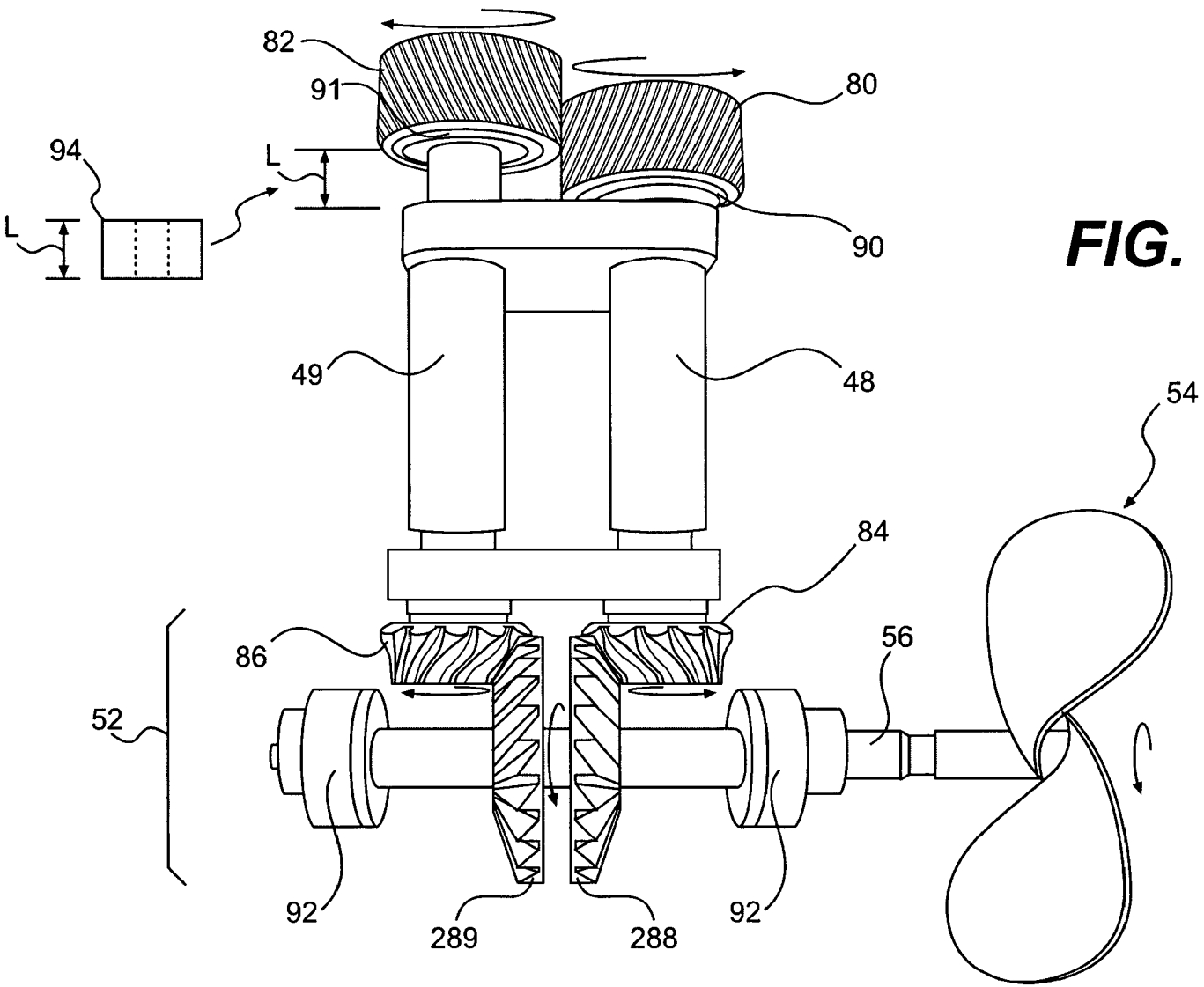
FIG. 6A is a partial cross-sectional view of an outboard engine according to a third embodiment.

Referring to FIG. 6A, a driven gear arrangement will be described according to an alternative embodiment. Two bull gears 288, 289 are mounted on the driveshaft 56 between the pinion gears 84, 86, in a similar manner to the bull gear 88 of FIGS. 2 and 4. The bull gear 288 meshes with the pinion gear 84, and the bull gear 289 meshes with the pinion gear 86. When the outboard engine 40 is in use, the pinion gears 84, 86 drive the bull gears 288, 289 respectively, to drive the propeller 54. The remaining components of the outboard engine are similar to those of the embodiment shown in FIGS. 2 and 4, and will not be described again in detail.

Figure 6B:
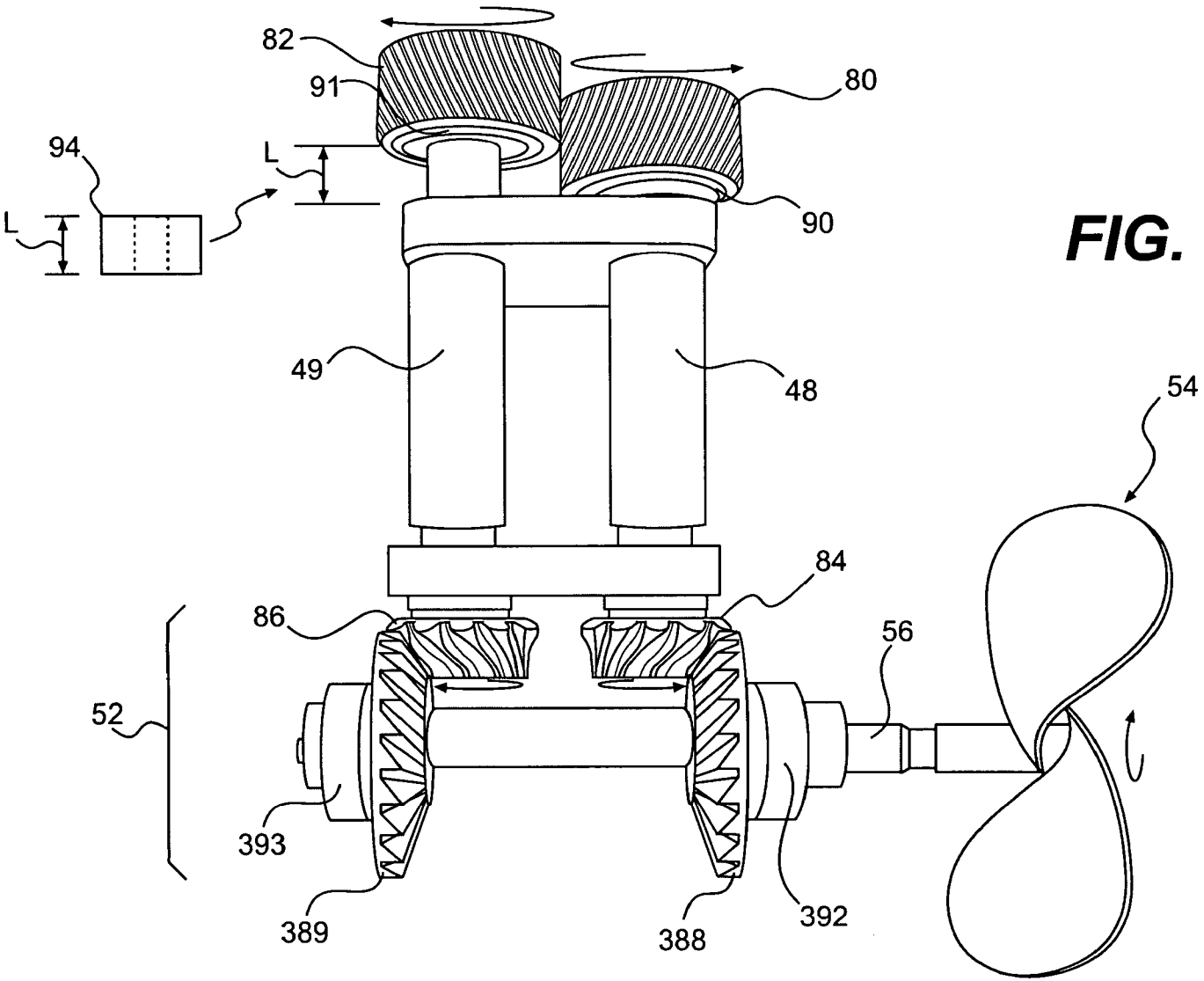
FIG. 6B is a partial cross-sectional view of an outboard engine according to a fourth embodiment.

Referring to FIG. 6B, a driven gear arrangement will be described according to an alternative embodiment. Two bull gears 388, 389 are mounted on the driveshaft 56, in a similar manner to the bull gear 88 of FIGS. 2 and 4. The bull gear 388 is mounted between the pinion gear 84 and the bearing 392. The bull gear 388 meshes with the pinion gear 84. The bull gear 389 is mounted between the pinion gear 86 and the bearing 393. The bull gear 389 meshes with the pinion gear 86. When the outboard engine 40 is in use, the pinion gears 84, 86 drive the bull gears 388, 389 respectively, to drive the propeller 54. The remaining components of the outboard engine are similar to those of the embodiment shown in FIGS. 2 and 4, and will not be described again in detail.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A method of assembling a marine outboard engine having:

an engine casing;

a first driveshaft having a first end and a second end, the first end having a first helical gear disposed thereon, and the second end having a first driving gear disposed thereon;

a second driveshaft having a first end and a second end, the first end having a second helical gear disposed thereon, and the second end having a second driving gear disposed thereon;

at least one height adjustment member associated with at least one of the first and second helical gears, the at least one height adjustment member being movable between a first position and a second position vertically higher than the first position; and a driven shaft having at least one driven gear disposed thereon;

the method comprising:

placing the first driveshaft in the engine casing such that the first helical gear is free to move in an axial direction relative to the engine casing;

placing the driven shaft in the engine casing such that one of the at least one driven gear meshes with the first driving gear;

placing the second driveshaft in the engine casing such that:

the second driving gear meshes with one of the at least one driven gear, the first helical gear meshes with the second helical gear, and the second helical gear is free to move in an axial direction relative to the engine casing;

rotating the driven shaft to cause an axial displacement of one of the first and second helical gears with respect to the engine casing as a result of the rotation of the driven shaft; and moving the at least one height adjustment member from the first position to the second position, the height of the second position being determined based at least in part on a magnitude of a relative axial displacement.

2. The method of claim 1, further comprising fixing the first and second helical gears in position after moving the at least one height adjustment member, such that axial movement of the first and second helical gears in an axial direction is substantially prevented.

3. The method of claim 1, wherein the at least one height adjustment member is at least one threaded height adjustment member, and wherein moving the at least one height adjustment member comprises rotating the at least one height adjustment member.

4. The method of claim 1, wherein the at least one driven gear is a single driven gear;

placing the driven shaft in the engine casing such that one of the at least one driven gear meshes with the first driving gear comprises placing the driven shaft in the engine casing such that the driven gear meshes with the first driving gear; and placing the second driveshaft in the engine casing such that the second driving gear meshes with one of the at least one driven gear comprises placing the second driveshaft in the engine casing such that the second driving gear meshes with the driven gear.

5. The method of claim 1, wherein the at least one driven gear comprises first and second driven gears;

placing the driven shaft in the engine casing such that one of the at least one driven gear meshes with the first driving gear comprises placing the driven shaft in the engine casing such that the first driven gear meshes with the first driving gear; and placing the second driveshaft in the engine casing such that the second driving gear meshes with one of the at least one driven gear comprises placing the second driveshaft in the engine casing such that the second driving gear meshes with the second driven gear.

* * * * *